US007537506B2

(12) United States Patent
de la Torre

(10) Patent No.: US 7,537,506 B2
(45) Date of Patent: May 26, 2009

(54) TOY FIGURE ADAPTED TO TRANSFER AN OBJECT

(75) Inventor: Gabriel de la Torre, Bell Gardens, CA (US)

(73) Assignee: Mattel, Inc., El Segundo, CA (US)

( * ) Notice: Subject to any disclaimer, the term of this patent is extended or adjusted under 35 U.S.C. 154(b) by 15 days.

(21) Appl. No.: 11/733,147

(22) Filed: Apr. 9, 2007

(65) Prior Publication Data

US 2008/0026670 A1 Jan. 31, 2008

Related U.S. Application Data

(60) Provisional application No. 60/790,224, filed on Apr. 7, 2006.

(51) Int. Cl.
*A63H 11/00* (2006.01)

(52) U.S. Cl. ..... 446/353; 446/308; 446/92; 446/369

(58) Field of Classification Search ..... 446/353, 446/308, 139, 369
See application file for complete search history.

(56) References Cited

U.S. PATENT DOCUMENTS

| | | | | |
|---|---|---|---|---|
| 2,213,901 | A * | 9/1940 | Crawford | 446/139 |
| 3,648,405 | A | 3/1972 | Tepper | |
| 3,693,288 | A | 9/1972 | Lewis et al. | |
| 3,978,611 | A * | 9/1976 | Strongin | 446/298 |
| 4,003,158 | A | 1/1977 | Wolf et al. | |
| 4,038,775 | A | 8/1977 | Sato | |
| 4,118,888 | A | 10/1978 | Ogawa | |
| 4,170,840 | A | 10/1979 | Ogawa | |
| 4,176,492 | A | 12/1979 | Sims et al. | |
| 4,183,173 | A | 1/1980 | Ogawa | |
| 4,186,515 | A | 2/1980 | Ogawa | |
| 4,186,517 | A | 2/1980 | Kuhn et al. | |
| 4,206,564 | A | 6/1980 | Ogawa | |
| 4,277,643 | A | 7/1981 | Saligny | |
| 4,578,045 | A | 3/1986 | Mayer et al. | |
| 4,579,542 | A | 4/1986 | Mayer et al. | |
| 4,596,532 | A | 6/1986 | Cook et al. | |
| 4,601,672 | A | 7/1986 | Cook et al. | |
| 4,605,382 | A | 8/1986 | Cook et al. | |
| 4,608,026 | A | 8/1986 | Newton et al. | |
| 4,623,318 | A | 11/1986 | Tsiknopoulos et al. | |
| 4,723,932 | A | 2/1988 | Kelley et al. | |
| 4,725,257 | A | 2/1988 | Barishman et al. | |
| 4,968,280 | A | 11/1990 | Kelley | |
| 5,277,643 | A | 1/1994 | Ejima | |
| 5,295,889 | A | 3/1994 | Ejima | |
| 5,380,233 | A | 1/1995 | Umoto | |
| 5,727,717 | A | 3/1998 | Vigne | |
| 5,906,531 | A | 5/1999 | Llorens | |
| 5,975,979 | A | 11/1999 | Ferri Llorens | |

(Continued)

FOREIGN PATENT DOCUMENTS

| | | |
|---|---|---|
| GB | 2186203 | 8/1987 |

*Primary Examiner*—Gene Kim
*Assistant Examiner*—Michael D Dennis
(74) *Attorney, Agent, or Firm*—Kolisch Hartwell, P.C.

(57) ABSTRACT

Toy figures having a moveable appendage, an object associated with the toy figure at a first position, and a transfer mechanism configured to couple the moveable appendage with the object, and transfer the object to a second position on the figure.

9 Claims, 4 Drawing Sheets

U.S. PATENT DOCUMENTS

| | | | | |
|---|---|---|---|---|
| 6,022,263 | A | 2/2000 | Liu et al. | |
| 6,106,359 | A | 8/2000 | Arriola | |
| 6,171,169 | B1 | 1/2001 | Saunders | |
| 6,224,456 | B1 | 5/2001 | Wittenberg | |
| 6,296,543 | B1 | 10/2001 | Andrews | |
| 6,547,625 | B2 | 4/2003 | Whitehead | |
| 6,712,667 | B1 * | 3/2004 | Melzer et al. | 446/92 |
| 6,824,442 | B2 | 11/2004 | Andrews et al. | |

* cited by examiner

TOY FIGURE ADAPTED TO TRANSFER AN OBJECT

RELATED APPLICATIONS

This application claims priority under 35 U.S.C. § 119(e) to U.S. Provisional Application No. 60/790,224 filed on Apr. 7, 2006, the disclosure of which is incorporated herein by reference for all purposes.

BACKGROUND

Toy figures of all kinds are popular toys, and toy figures that represent a popular character, such as a cartoon character, superhero, villain, television personality, among others, may be particularly popular. By adapting a toy figure to carry out an associated action, the play value of the figure may be increased.

Examples of toy figures are found in U.S. Pat. Nos. 2,213,901; 3,648,405; 3,693,288; 4,003,158; 4,186,517; 4,578,045; 4,579,542; 4,596,532; 4,601,672; 4,605,382; 4,608,026; 4,623,318; 4,723,932; 4,725,257; 4,968,280; 5,906,531; 5,975,979; 6,022,263; 6,106,359; 6,224,456; 6,296,543; 6,547,625; 6,824,442; and Foreign Patents GB 2186203, each of which is hereby incorporated by reference, for all purposes.

SUMMARY

The present disclosure describes toy figures having a moveable appendage, an object associated with the toy figure at a first position, and a transfer mechanism configured to couple the moveable appendage with the object and transfer the object to a second position on the figure.

DETAILED DESCRIPTION

Figure 1:
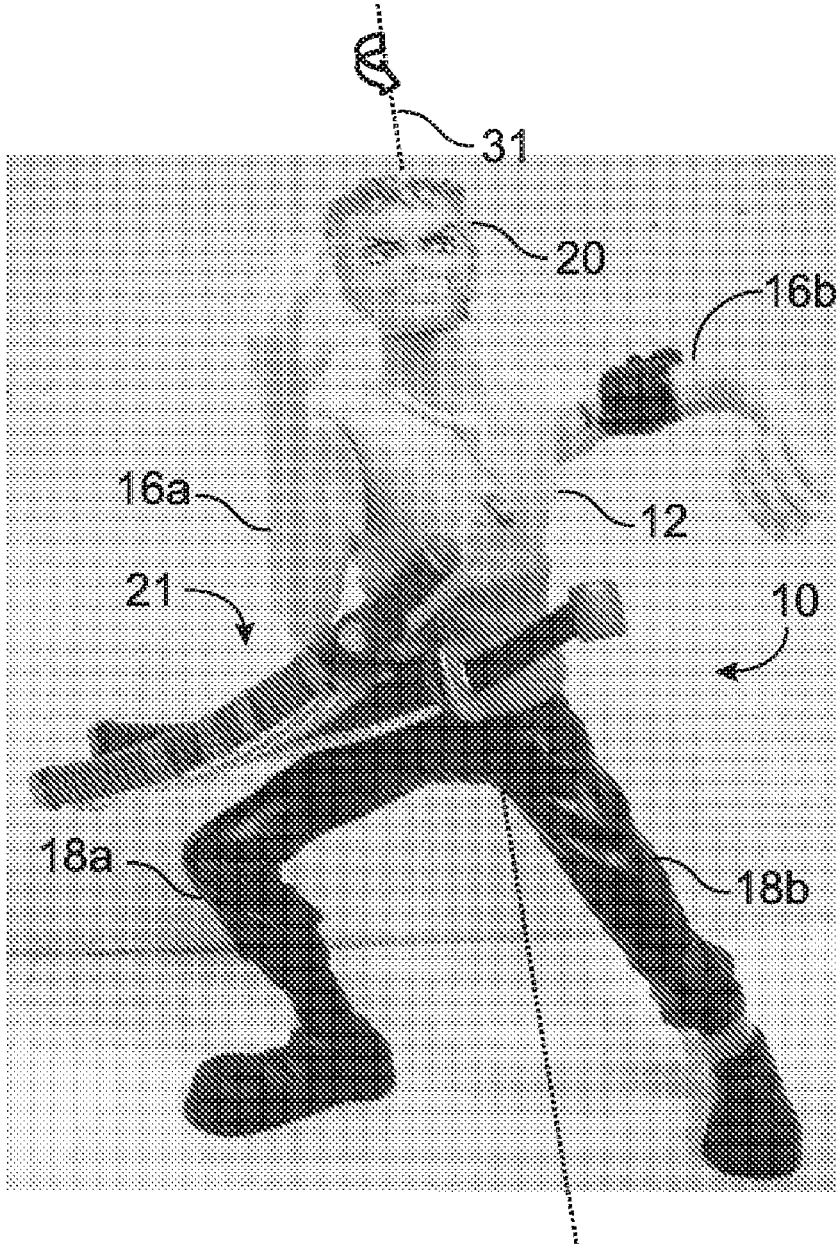
FIG. 1 is a front view of an exemplary toy figure according to the present disclosure.

A toy configured to transfer an associated object is illustrated in FIGS. 1-9. The toy may be a vehicle, an animal, a piece of equipment, a humanoid figure, or other type of toy. Where the toy is a toy action figure, the action figure may be a 6-inch or 12-inch action figure, among others. As shown in FIG. 1, toy FIG. 10 may include a torso 12, and several appendages, such as legs 16*a* and 16*b*, arms 18*a* and 18*b*, and head 20.

Toy FIG. 10 is generally configured to include one or more associated objects 21 in an accessible position. The toy figure is further configured so that upon activation of a transfer mechanism, one or more appendages of the figure transfers one or more of the associated objects from a first position on or relative to the toy figure to a second position on the toy figure.

The toy figure of FIGS. 1-9 is configured to appear as a swashbuckler/swordsman. Associated objects 21 take the form of swords. However, the toy figure may be configured to reflect any of a variety of creatures, professions, hobbies, and/or activities. The toy figure may be configured to represent, for example, a human, animal, robot, or fanciful creature. The toy figure may be configured to represent a secret agent, a police officer, a soldier, a sailor, a pilot, an astronaut, a cowboy, or a hunter, among others. The toy figure may therefore be accessorized with clothing and/or items appropriate for the toy figure's profession, hobbies and/or activities. The toy figure may include one or more associated objects such as hand-held weapons, tools, or instruments that reflect the profession, hobbies, and/or activities of a particular toy figure. For example, the toy figure may include, without limitation, an appropriate uniform or other clothing, helmet or hat, backpack, armor, scientific devices, communicators, or weapons. More particularly, the objects associated with the toy may be configured to be associated with the toy figure in an accessible position.

An accessible position, as the term is used herein, includes any position that can be reached by one of the toy figure's appendages. As such, accessible positions may include, without limitation, associated with the back of the toy figure, associated with the waist of the toy figure, associated with the chest of the toy figure, etc. Optionally, the object may be associated with an accessory such as a backpack, a belt, or a bandolier, or a holster, quiver, or sheath that appears to be attached to a backpack, a belt, or a bandolier. The accessory may be a discrete accessory worn by the toy figure, or it may be integrally formed on the toy figure in such manner as to appear to be worn by the toy figure.

The toy figure may further be configured so that activation of a transfer mechanism results in an appendage of the toy figure coupling with an associated object, followed by a transfer of the object by that appendage from its associated first position to a second target position also associated with the toy figure. The appendage may be any body part capable of movement, such as a tentacle, claw, hook, crane, grappling hook, arm, leg, etc. The appendage may include a plurality of individual segments optionally interconnected by a plurality of joints. These joints may be configured to move one appendage segment relative to another. For example, a selected joint may rotate, bend, or extend one segment relative to another segment. A given appendage may include various combinations of joints such that a first appendage segment rotates relative to second segment, while a third segment bends relative to the second segment, etc. Different appendages may include different combinations of segments and joints, and sets of appendages may be provided to allow a user to interchangeably customize customizable toy figures.

In some embodiments, the appendage that couples with an object includes a hand, and activation of the transfer mechanism results in a movement of an arm of the toy figure to bring the hand connected to the moving arm into contact or close proximity with the associated object. Examples include rotating the arm upward so that the hand reaches over the toy figure's shoulder, rotating the arm downward so that the hand reaches toward the toy figure's waist or leg, and rotating the arm across the toy figure laterally to reach toward the opposite side of the toy figure, among others.

As the moving hand reaches the associated object, the moving hand may become coupled with the associated object. Coupling of the hand with the object may be accomplished by any of a variety of methods, illustrative and nonexclusive examples of which include magnetic interaction, a hook-and-loop closure, a releasable adhesive, an elastic flexion of the hand to grasp a portion of the associated object, and so forth. The coupling between the hand and the associated object should be at least strong enough to remove the object from its position associated with the toy figure, or the first position.

The activation of the transfer mechanism may bring a hand to an associated object and then bring the object to a second associated position in a single motion. Alternatively, a first activation of the transfer mechanism may bring a hand to an associated object, and a second activation of the transfer mechanism may bring the object to the second position associated with the toy figure. In another alternative aspect, an activation of the transfer mechanism may bring the hand to the associated object, and a release of the transfer mechanism may bring the object into a second position. In yet another alternative configuration, activation of the transfer mechanism couples multiple appendages with multiple associated objects, so that each object is then transferred from its first position to a second position associated with the toy figure.

The transfer mechanism may be configured to transfer an associated object from a first position on a toy body to a target portion of the toy body. The second associated position, or deployed position, may be any of a variety of positions. The second associated position may be representative of the appropriate operation of the object that has been transferred. For example, where the object is a gun, the deployed position may be pointed forward. Where the object is a sword, the deployed position may be pointing forward, pointing upward, or pointing to one or the other sides. Where the object is a sensor, the deployed position may point the sensor at an object to be sensed.

An associated object may be associated with the figure at either the first or second position via a releasable connection. The releasable connection may include resting in a holster or pouch, resting in a loop or ring, attached via a hook-and-loop closure, attached via magnetic interaction, attached via releasable adhesive, attached via a peg or post inserted into an aperture, and so forth. The connection may be substantially releasable, that is, the force applied to the object by an appendage that couples to the object when moving it into a second position should be sufficient to detach the object from its associated position, or at least detach the object where it is releasably connected. A given object may incorporate further releasable or nonreleasable connections to the toy figure, such as a tether, an electrical connection, a fiber optic connection, a fluid delivery tube, and the like.

The transfer of an associated object by the toy figure may be accompanied by one or more output signals, such as light and/or sounds or sound effects, and so forth. Sound or sound effect may include recorded speech, such as sounds of speech appropriate for the use of the associated object. For example, where the object is a handheld scanner, transfer of the object may include triggering recorded speech such as "I'm detecting the enemy!" or "No enemies nearby!", and the like. Similarly, transfer of a handheld communicator may trigger one or both sides of an appropriate communicated conversation. Such speech or sound effects may be generated by the transferred object, or may be generated by an audio device included in the toy figure. Where the associated object is a weapon, the sound or sound effect may include sounds representative of combat, including the operation of the weapon, the sound of a parry, the cry of a wounded opponent, and the like.

In addition to associated and deployable objects, the toy figure may include a variety of other accessories, which may include, without limitation, projectile weapons such as pistols, rifles, rocket launchers, missile launchers, laser weapons; edged weapons such as knives, swords, axes, polearms, spears; electronic devices such as radios, telephones, computers, sensors; defensive devices such as shields, and armor; and/or more generic objects such as boulders, furniture, vehicles, and trees; among other possible accessories.

The toy figure may be configured for additional movements, including the existence of flexible joints at one or more of ankles, knees, hips, waist, shoulders, elbows, wrists, and neck. The flexible joints may include ball-and-socket joints or other appropriate joint mechanisms, so that the toy figure is at least partially poseable.

The various components of the toy figure and the accessories, if present, may be fabricated from any suitable material, or combination of materials, such as plastic, foamed plastic, wood, cardboard, pressed paper, metal, or the like. A suitable material may be selected to provide a desirable combination of weight, strength, durability, cost, manufacturability, appearance, safety, and the like. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, or the like. Suitable foamed plastics may include expanded or extruded polystyrene, or the like.

The construction and operation of the disclosed toy figures may be better understood when considered in the context of a specific exemplary embodiment of the toy figure. Referring to the illustrative embodiment shown in FIGS. 1-9, toy FIG. 10 includes a torso 12, legs 16*a* and 16*b*, arms 18*a* and 18*b*, and head 20. Toy FIG. 10 incorporates a transfer mechanism 22 that may be supported in torso 12, with an actuator operatively connected to transfer mechanism 22, which is in turn operatively connected with one or more appendages 16.

Figure 2:
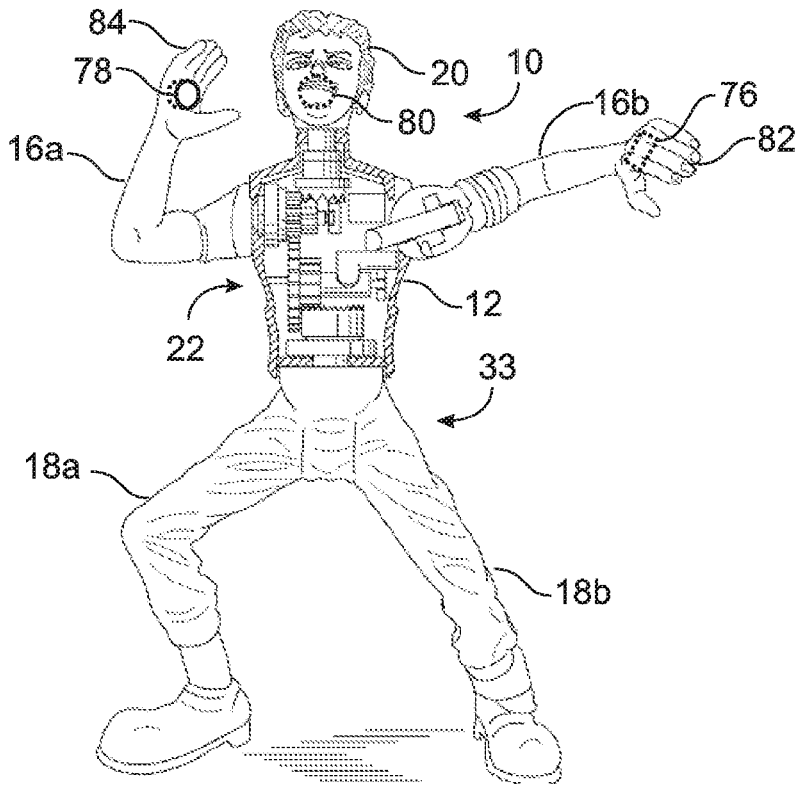
FIG. 2 is a front cutaway view of the exemplary toy figure of FIG. 1.

Torso 12 may house transfer mechanism 22 as shown in FIG. 2. Torso 12 may define an interior space or cavity of sufficient size to contain transfer mechanism 22. Various projections, apertures, and support members may be provided on the interior surface of torso 12 to support the various components of transfer mechanism 22. Torso 12 may include shoulder apertures 23 and 24, which permit an operative connection to exist between transfer mechanism 22 and appendages 16.

Figure 3:
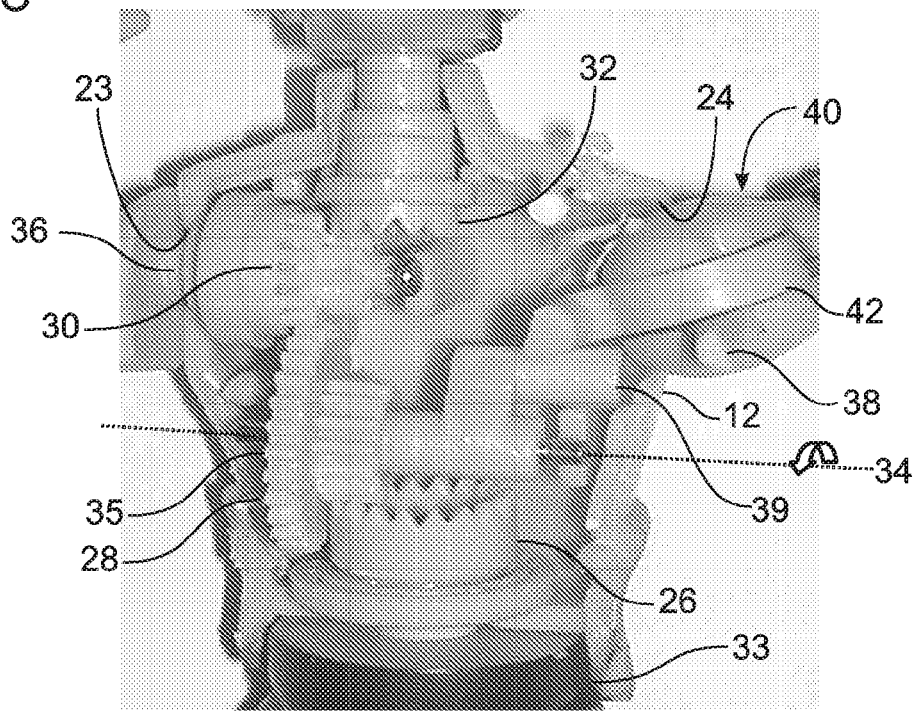
FIG. 3 is a cutaway view of the torso of the exemplary toy figure of FIG. 1, showing the transfer mechanism.

Transfer mechanism 22 may be configured to transmit energy and motion applied to the mechanism to appendages 16 and 20 through a series of interactive gears. As shown in FIGS. 2 and 3, Transfer mechanism 22 may include waist gear 26, torso gear 28, shoulder gear 30, and neck gear 32. Each of the aforementioned gears may be operatively connected such that movement of one gear causes the other gears to move.

Toy FIG. 10 is configured so that energy and motion may be applied to the transfer mechanism by rotation of the torso 12 around a vertical axis of rotation 31 with respect to the lower body 33. Such rotation may be easily accomplished by a user by simply twisting the torso section of the figure, relative to the legs and lower body.

Waist gear 26 may be fixedly secured to lower body 33 and therefore rotate with respect to torso 12 when the torso and lower body are twisted relative to each other. Waist gear 26 may engage torso gear 28, which may have a horizontal axis of rotation 34, so that as waist gear 26 rotates it drives the rotation of torso gear 28 about horizontal axis 34.

Torso gear 28 may then in turn engage shoulder gears 30 so that shoulder gears 30 rotate about their respective horizontal axis. In some embodiments, customizable toy FIG. 10 may include one shoulder gear 30 and a different movement mechanism or no mechanism at all in the other shoulder. As shown in FIGS. 2 and 3, torso gear 28 may comprise a spur gear 35 that is configured to engage shoulder gear 30.

Shoulder gear 30 may in turn drive the movement of arm 16*a* when driven by torso gear 28. Arm 16*a* may couple to shoulder gear 30 at shoulder recess 23, so that rotation of shoulder gear 30 drives rotation of arm 16*a*. As explained more fully below, arm 16*a* may be coupled via a mating mechanism 36, which may transmit the energy transferred to it by shoulder gear 30 to the various joints present in appendage 16*a*.

Shoulder gear 30 may additionally couple to neck gear 32, so that rotation of shoulder gear 30 results in rotation of neck gear 32, and therefore rotation of head 20. In some examples, neck gear 32 may be a mushroom gear with an articulation point located in the head. Neck gear 32 may rotate about a vertical axis when driven by shoulder gear 30. Neck gear 32 may be rigidly attached to head 20 and, as a result, head 20 may rotate as neck gear 32 rotates.

Transfer mechanism 22 may be configured so that neck gear 32 and waist gear 26 rotate in the same direction. However, transfer mechanism 22 may alternatively be configured such that neck gear 32 and waist gear 26 rotate in opposite (contrary) directions. Further, transfer mechanism 22 and neck gear 32 may incorporate gearing of various ratios so that neck gear 32 and waist gear 26 may rotate at the same rate or different rates.

An alternative coupling mechanism may be used between transfer mechanism 22 and arm 16*b*. For example, arm projection 38 may extend from arm 16*b* into the cavity defined by torso 12 via shoulder aperture 24. Arm projection 38 may be rigidly connected to arm 16*b* and adapted to couple with paddle 39, as paddle 39 rotates around rotation axis 34 as torso gear 28 turns. This coupling results in the pivoting of arm 16*b* where it attaches to torso 12 as transfer mechanism 22 is operated.

Arm 16*b* may be configured to pivot in this manner by incorporating a shoulder pivot mechanism 40 adapted to pivot arm 16*b*. Shoulder pivot mechanism 40 may include a pivot shaft, a forward biasing member, and a reverse biasing member. The pivot shaft may extend through an aperture in a connection member 42. Forward and reverse biasing members may cooperatively bias arm 16*b* in a preferred orientation.

Figure 4:
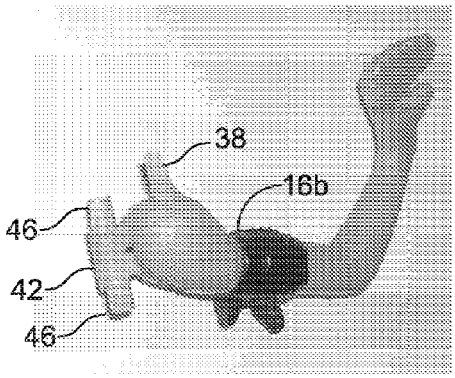
FIG. 4 is a perspective view of an arm of the exemplary toy figure of FIG. 1.

Connection member 42 may couple arm 16*b* to torso 12. Connection member 42 may include an aperture that receives the shoulder pivot shaft at one end of the connection member, and a connection shaft 44 at another end of the connection member. As shown in FIG. 4, connection shaft 44 may include two (male) projections 46 that may attach to torso 12 by way of a friction and/or compression fit inside corresponding (female) cavities molded into the front and rear interior walls of torso 12. The cavity and connection shaft 44 may be complementarily shaped so that upon mating, they cooperative in restricting rotation of connection shaft 44. As a result, arm 16*b* is restricted from motion in any plane other than the rotation around the shoulder pivot shaft that is created by the action of paddle 39 on projection 38, which brings arm 16*b* down and across the body of toy FIG. 10.

Figure 5:
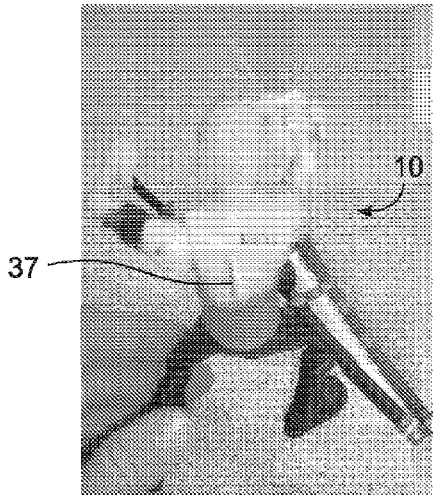
FIG. 5 is a rear perspective view of the exemplary toy figure of FIG. 1.

As discussed above, transfer mechanism 22 may be actuated by rotation of the torso with respect to the lower body. However, transfer mechanism 22 may be actuated by a variety of alternative actions. For example, transfer mechanism 22 may be actuated by sliding a belt around torso 12, depressing a button configured to move into and out of torso 12, moving a lever that is configured to pivot into and out of torso 12, and so forth. Where rotation of the torso with respect to the lower body is used to activate transfer mechanism 22, such rotation may be facilitated by the presence of a handle or tab 37 on the torso with which a user may exert rotating force, as shown in FIG. 5. In addition, the toy figure may be configured so that a first direction of rotation may result in toy FIG. 10 twisting to the right and a second direction of rotation may result in toy FIG. 10 twisting to the left. Tab 37 may facilitate twisting by a user placing a thumb thereon to exert twisting force.

Toy FIG. 10 may include associated objects 21, as shown in FIG. 1. Viewed in greater detail, associated objects 21 include swords 48, 50 and 52, which are associated with toy FIG. 10 via sheath unit 54. Sheath unit 54 may be associated with the toy figure by way of a frictional fit between a post on the figure and a corresponding cavity on the sheath unit. Any other suitable attachment, such as hook-and-loop closure, magnetic coupling, adhesive, and the like, may be used to associate the sheath unit with the toy figure. Sheath unit 54 may be a molded piece that incorporates three sheaths. Alternatively, each sword may have a distinct sheath unit.

Sheath unit 54 may retain swords 48, 50, and 52 via a frictional fit. Each individual sheath segment 56, 57, and 58 may include a corresponding slit 60, 61, and 62 extending at least partially from the mouth of the sheath to the distal end of the sheath segment. The presence of such a slit may facilitate placement of the sword in the appropriate sheath and/or facilitate drawing the sword from the appropriate sheath. A given sword may be placed within its respective sheath via the mouth of the sheath, or via the corresponding slit in the sheath segment.

As discussed above, the associated objects may include a mechanism for coupling with an appendage. In the case of swords 48, 50, and 52, each sword may include a handle portion 64, 66, and 68, respectively, which may include a corresponding magnet 70, 72, and 74. In order to create a magnetic coupling with the sword handles, additional magnets 76, 78, and 80 are incorporated in left hand 82, right hand 84, and mouth 86 on head 20, respectively.

Figure 7:
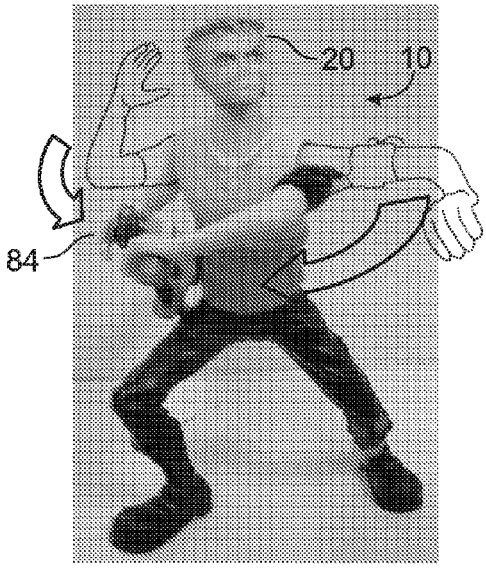
FIG. 7 is a front perspective view of the exemplary toy figure of FIG. 1 showing actuation of the transfer mechanism.

As depicted in FIG. 7, when torso 12 is twisted in a first direction relative to lower body 33 (toward the figure's right), the action of paddle 39 on arm projection 38 pivots arm 16*b* down and across the body of the toy figure. As a result, magnet 76 in hand 82 is placed in close proximity to magnet 70 in handle 64 of sword 48. Sword 48 is thereby magnetically coupled to hand 82, and as torso 12 is twisted in a second direction relative to lower body 33, sword 64 is withdrawn from sheath 58.

Simultaneously, or sequentially with coupling and withdrawing sword 48, arm 16*a* with hand 84 pivots down to place magnet 78 in close proximity to magnet 72 in handle 66 of sword 50, and as torso 12 is twisted in a second direction, sword 50 is withdrawn from sheath 56.

Figure 6:
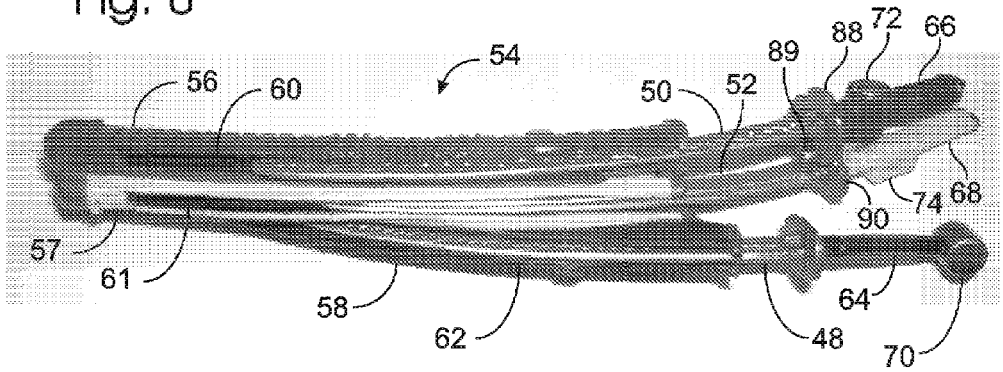
FIG. 6 is a perspective view of associated objects for the exemplary toy figure of FIG. 1.

As shown in FIG. 6, hilt 88 of sword 50 may define a notch, and a complementary tab 89 on the hilt 90 of sword 52 may correspond to and fit within the notch of hilt 88, so that hilt 90 rests upon hilt 88. As a result, as sword 50 is drawn from sheath 56 by hand 84, sword 57 may also drawn from sheath 57. As the swords are fully withdrawn, magnets 72 and 74 in the respective sword handles may become coupled to each other and to magnet 78 of hand 84. This may result in hand 84 withdrawing both swords simultaneously.

Figure 8:
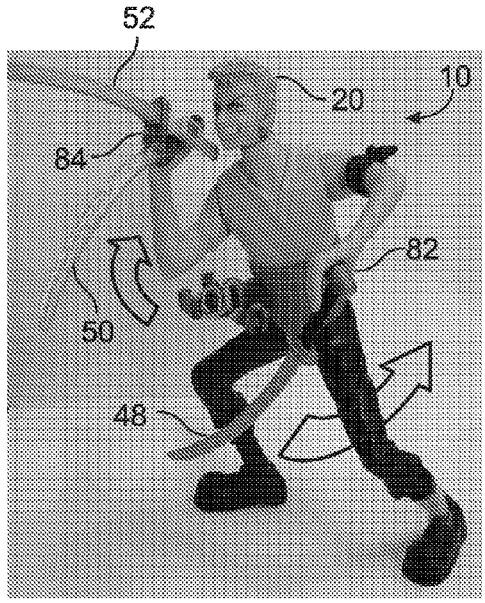
FIG. 8 is a perspective view of the exemplary toy figure of FIG. 1 showing further actuation of the transfer mechanism.
Figure 9:
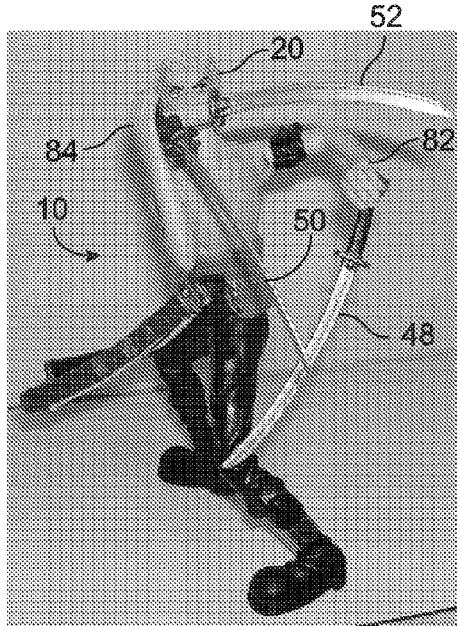
FIG. 9 is a perspective view of the exemplary toy figure of FIG. 1 showing even further actuation of the transfer mechanism.

Arms 16*a* and 16*b* may pivot reciprocally away from sheath unit 54 when torso 12 is twisted relative to lower body 33 in a second direction, as shown in FIG. 8. The arms may pivot simultaneously or sequentially. As the arms 16 rotate away from sheath unit 54, swords 48, 50, and 52 are withdrawn from their respective sheath segments, with hand 82 of arm 16*b* moving sword 48 and hand 84 of arm 16*a* moving swords 50 and 52.

Toy FIG. 10 may be configured to transfer one of the associated objects from one position on the figure to a second position on the figure as the transfer mechanism is actuated. For example, as arm 16*a* pivots further, head 20 may simultaneously pivot toward hand 84, thereby putting the handle 68 of sword 52 in close proximity to head 20. Head 20 may be configured to include a magnet 80, for example located near or behind the depicted mouth of the toy figure. Where head 20 includes a magnet 80, the magnet may be selected and configured to exert an attractive force on magnet 74 of sword 52. The relative strength of the attraction, and the relative proximity of the magnets may be selected so that magnet 74 becomes magnetically coupled to magnet 80, thereby coupling sword 52 to head 20.

The attractive force between magnet 74 and magnet 80 may be sufficient to overcome the coupling force between magnets 72 and 74. This attractive force may be selected so as to overcome the coupling between sword 50 and sword 52, irrespective of whether the swords are coupled by mechanical or magnetic means. Thus, a selective transfer of sword 52 between different parts of toy FIG. 10 may be facilitated by configuring the attractive force between sword 52 and head 20 to be stronger than the coupling force between sword 52 and sword 50.

Sword 52 may be configured so that the transfer of the sword to head 20 results in a desired final orientation. The size and shape of sword 52, including handle 68, may be selected so that sword 52 assumes a substantially horizontal final orientation, as shown in FIG. 8. Subsequent activation of the transfer mechanism may then be used to pivot the figure's arms, perhaps to simulate swordplay, without disturbing the placement or orientation of sword 52 in its second or deployed position. In particular, the length of handle 68 may be tailored to produce the desired ease of transfer between sword 50 and head 20, and the desired orientation of the sword.

As shown in FIG. 8, upon completion of the transfer of sword 52 from sheath unit 57 to head 20, as well as the engagement of swords 48 and 50 by hands 82 and 84, toy FIG. 10 substantially resembles a swordsman wielding three swords. Specifically, the toy figure appears to be wielding a sword in each hand, and grasping one in its mouth. The transfer mechanism provides a smooth and rapid transition from all three swords being sheathed at the figure's side, to the figure being ready for combat with all three blades. This lifelike transfer of the sword from a first position (the sheath) to a second position (the head/mouth) provides an enhanced lifelike quality to the figure as well as the figure's actions, thereby increasing the play value of the toy figure.

Although the present invention has been shown and described with reference to the foregoing operational principles and preferred embodiments, it will be apparent to those skilled in the art that various changes in form and detail may be made without departing from the spirit and scope of the invention. For example, variations in the details of the toy figure appearance, the toy figure accessories, and the toy figure operation may be envisioned. The present invention is intended to embrace all such alternatives, modifications and variances that fall within the scope of the appended claims.

What is claimed is:

1. A toy comprising:

a toy body;

a target toy body portion, including a magnet;

three objects associated with the toy body, each object including a magnet;

two moveable appendages connected to the toy body, each appendage including a distal magnet; and an actuatable transfer mechanism within the toy body, the transfer mechanism configured when actuated to:

automatically pivot a first appendage to magnetically couple a first distal magnet to a first associated object, then pivot the first appendage to remove the object from the toy body; and to automatically pivot a second appendage to magnetically couple a second distal magnet to a second and third associated objects, then pivot the second appendage so that the third object magnetically couples to the magnet of the target body portion and decouples from the second appendage, thereby transferring the third object from the toy body to the target body portion.

2. The toy of claim 1, wherein the toy is an action figure comprising:

a torso portion of the toy body;

a lower portion of the toy body;

a target toy body portion that is a head; and two moveable appendages that are arms connected to the torso, each arm having a distal hand that includes a magnet; where the three associated objects are swords that are associated with the lower body via a sheath unit, each sword having a handle that includes a magnet; and where the actuatable transfer mechanism is within the torso and is configured when actuated to:

automatically pivot a first arm to magnetically couple a first hand to a first sword handle, then pivot the first arm to remove the sword from the lower body; and to automatically pivot a second arm to magnetically couple a second hand to a second and third sword handle, then pivot the second arm so that the third sword handle magnetically couples to the magnet of the head and decouples from the second arm, thereby transferring the third sword from the lower body to the head.

3. The toy of claim 2, where the transfer mechanism is configured so that twisting the torso in a first direction couples the first hand with the first sword handle and couples the second hand to the second and third sword handles, and twisting the torso in a second direction transfers the third sword from the lower body to the head.

4. The toy of claim 2, where the second sword includes a second sword hilt and the third sword includes a third sword hilt, and the sheath unit is configured so that while the swords are associated with the lower body via the sheath unit the second and third sword hilts overlap, and such overlap facilitates the coupling of the second and third swords with the second hand.

5. The toy of claim 4, where the second sword hilt defines a notch, and the third sword hilt includes a tab, such that when the second and third sword hilts overlap, the tab is configured to fit within the notch.

6. The toy of claim 2, where the toy figure is configured so that after the transfer mechanism transfers the third sword from the lower body to the head, the third sword handle is coupled to the head at the mouth and the third sword is oriented horizontally.

7. The toy of claim 2, where the transfer mechanism includes a vertically disposed waist gear that is connected to the lower body and engaged with a horizontally disposed torso gear housed within the torso, which is in turn engaged to a shoulder gear that is connected to an arm, the transfer mechanism being configured so that twisting the torso with respect to the lower body pivots the arm.

8. The toy of claim 7, where the shoulder gear engages a neck gear that is connected to the head, so that twisting the torso with respect to the lower body additionally pivots the head.

9. The toy of claim 7, where the horizontally disposed torso gear further comprises a paddle that couples with a projection connected to a second arm of the figure, so that twisting the torso with respect to the lower body additionally pivots the second arm.

* * * * *